US010045626B1

(12) United States Patent
Cheetham

(10) Patent No.: US 10,045,626 B1
(45) Date of Patent: Aug. 14, 2018

(54) PORTABLE ELBOW REST AND METHOD OF USE

(71) Applicant: Stephen H Cheetham, Phoenix, AZ (US)

(72) Inventor: Stephen H Cheetham, Phoenix, AZ (US)

( * ) Notice: Subject to any disclaimer, the term of this patent is extended or adjusted under 35 U.S.C. 154(b) by 267 days.

(21) Appl. No.: 14/827,637

(22) Filed: Aug. 17, 2015

Related U.S. Application Data

(60) Provisional application No. 62/041,603, filed on Aug. 25, 2014.

(51) Int. Cl.
*A47C 7/54* (2006.01)
*A47C 16/00* (2006.01)

(52) U.S. Cl.
CPC ..... *A47C 7/546* (2013.01); *A47C 16/00* (2013.01)

(58) Field of Classification Search
CPC combination set(s) only.
See application file for complete search history.

(56) References Cited

U.S. PATENT DOCUMENTS 2,070,397 A 2/1934 Fisher
2,172,178 A 10/1938 Rosenberg
3,114,527 A * 12/1963 Demarest ..... A47C 20/026 248/118
3,544,161 A * 12/1970 Bryden ..... A47C 7/543 297/391
4,005,840 A 2/1977 Ratkovich
4,560,201 A 12/1985 Scott
5,111,983 A 5/1992 Simmons et al.
5,169,103 A 12/1992 Jimenez et al.
5,385,322 A 1/1995 Kim et al.
5,385,536 A 1/1995 Burkhead et al.
5,465,408 A 11/1995 Sugayama et al.
6,270,160 B1 8/2001 Blake
6,336,576 B1 * 1/2002 Easter ..... A45F 3/04 224/153
6,789,344 B2 9/2004 Cain
6,938,862 B2 9/2005 Orona
6,966,069 B2 11/2005 Booth
6,973,691 B1 12/2005 Cordova et al.
7,203,970 B2 4/2007 Abanto et al.
7,563,236 B2 * 7/2009 Kazmierczak ..... A61F 5/3753 602/4
8,156,938 B2 4/2012 Maginness
(Continued)

*Primary Examiner* — Sarah B McPartlin
(74) *Attorney, Agent, or Firm* — Invention to Patent Services; Alex Hobson

(57) ABSTRACT

An elbow rest is configured to secure at least one of a user's elbow in a retained position while in a seated position. A user can then support their head with their hand or hands without their elbow or elbows slipping, sliding or moving. The elbow rest includes at least one support panel and a flexible strap attached thereto. In one embodiment, an elbow rest has a first and a second support panel with a flexible strap extending therebetween. In this embodiment, a person can rest their right and left elbows on the flexible strap proximal to the opposing support panels. The user can then support their head with both hands. The flexible strap may be detachably attached to the support panel to allow an adjustment of the flexible strap length between the support panels. A flexible strap may include non-slip surfaces to further prevent elbow and/or strap slippage.

11 Claims, 14 Drawing Sheets

(56) References Cited

U.S. PATENT DOCUMENTS

| | | | | |
|---|---|---|---|---|
| 8,256,049 | B1 * | 9/2012 | Sinks | A47C 16/00 5/632 |
| 8,333,308 | B2 | 12/2012 | Maginness | |
| 2007/0033732 | A1 | 2/2007 | Wooten | |
| 2009/0308989 | A1 | 12/2009 | Katz | |

* cited by examiner

PORTABLE ELBOW REST AND METHOD OF USE

CROSS REFERENCE TO RELATED APPLICATION

This application claims the benefit and priority to U.S. provisional patent application No. 62/041,603, filed on Aug. 25, 2014 and entitled Portable Elbow Rest; the entirety of which is incorporated by reference herein.

BACKGROUND OF THE INVENTION

Field of the Invention

The present invention relates to portable elbow rests and, in particular those for facilitating sleeping in a seated position.

Background

Sleeping in a seated position is difficult and uncomfortable as a person's unsupported head will tilt forward, back or from side to side. Sleeping while in a seated position is often times interrupted from a person's head tilting one direction or another. In addition, without proper head support, a person may incur neck strain as they sleep with their head tilted in an awkward manner. Many people rest their elbow or elbows on a support, such as an armrest, table or their own legs, and then support their head with their hand or hands. These attempts to support the head also typically lead to interrupted sleep, as the person's elbows slip or slide along or off the support.

A number of different types of head supports are available for people to configure around their necks or head. However, these devices are generally bulky and many people find them uncomfortable as they wrap, at least partially, around the person's neck. Travel pillows typically comprise a C-shaped pillow or inflatable bladder that is placed around a person's neck in an effort to support the head. Many people find these travel pillows ineffective, as they do not sufficiently support the head. Many people find that their heads still tilt too much in one direction with the travel pillow around their neck. In addition, some people find travel pillows constrict their neck, which can make it difficult to breath.

There exists a need for a portable device that can be used to aid in supporting a person's head when in a seated position.

SUMMARY OF THE INVENTION

The invention is directed to an elbow rest that is configured to secure at least one of a user's elbows in a retained position while in a seated position. A user can then support their head with their hand or hands without their elbow or elbows slipping, sliding or moving. The elbow rest comprises at least one support panel and a flexible strap attached thereto. The flexible strap may be detachably attached to the support panel through any suitable means to enable length adjustment of the extended portion of the strap. In an exemplary embodiment, a user places a support panel along one side of them, when seated, and then extends the flexible strap across their thorax or their across the top of their abdomen as shown in FIG. 7. The strap may extend across a user upper waist. The user can then place their opposite, or far arm, on the flexible strap and their near elbow on the flexible strap proximal to the support panel. In another exemplary embodiment, an elbow rest comprises a first and second support panel with a flexible strap extending therebetween. In this embodiment, a person can rest their right and left elbows on the flexible strap proximal to the opposing support panels. The user can then support their head with both hands.

An exemplary support panel may have any suitable length, width and thickness. In an exemplary embodiment, a support panel is configured with compact dimensions to enable a person to carry the entire elbow rest in a pocket book or brief case. For example, the length of the support panel or panels may be no more than about 15 inches, or no more than about 12 or 10 inches. A support panel may be made out of any suitable material including wood, plastic, epoxy, fiberboard, cardboard, composites and any combination of materials listed. In an exemplary embodiment, a support panel is lightweight for portable transport.

An exemplary strap may have any suitable length, width and thickness. The length may be about 10 inches or more, about 12 inches or more, about 15 inches or more, about 24 inches or more, or about 30 inches or more. The extended length of the flexible strap between the two support panels may be any suitable length including about 10 inches or more, about 12 inches or more, about 15 inches or more, about 24 inches or more, or about 30 inches or more. The length of the strap and the length of the extended portion of the strap may be configured for any size person. The width of the flexible strap may be configured to match the length of the support panels. The width of the strap may be substantially uniform over the length of the strap or may be enlarged over a portion of the strap, such as over an extended portion between the support panels, or proximal to a free end in embodiments with only a single support panel.

A flexible strap may comprise any suitable material including, but not limited to, natural or synthetic fabrics, including wovens, non-wovens, leather, and the like, foams and any combination thereof. A flexible strap is supple and can be coiled into a roll of material or folded upon itself for storage. A flexible strap may comprise a non-slip surface material on a top side that prevents a person's elbow or arm from easily slipping off and/or a non-slip surface on the bottom side that effectively retains the flexible strap in a position about a person's thorax, waist or legs.

The flexible strap may be affixed to a support panel and not readily detached, wherein the flexible strap is adhered, glued, stapled or otherwise affixed to the support panel. In an exemplary embodiment, the flexible strap is detachably attachable to a support panel and comprises a strap attachment feature such as a snap, button, latch or latch opening, hook and loop fastener and the like. A support panel may comprise a panel attachment feature configured to detachably couple with the strap attachment feature to enable attachment and detachment of the flexible strap to the support panel. The flexible strap may comprise one or more strap attachment features and these attachment features may be configured proximal to the extended ends in any suitable location along the length of the flexible strap. For example, a hook portion of a hook and loop fastener may extend along the length of the flexible strap and be configured to detachably attach to the loop portion of the hook and loop fastener configured on the support panel. A support panel may comprise one or more panel attachment features configured in any suitable location along the support panel. In an exemplary embodiment, the panel attachment features are configured along the outside, or outward facing surfaces of the support panel relative to a seated user and the flexible strap is configured to extend over the support ends and down a portion of the outside surface of the support panel.

In an exemplary embodiment, an elbow rest comprises a first support panel, a second support panel, a support extended strap portion and a base extended strap portion. The support extended strap portion extends from the support ends of the first and second support panels and the base extended strap portion extends from the base ends of the first and second support panels. Two separate flexible straps may be configured between the support panels in this embodiment wherein a first flexible strap extends over the two support ends and is attached to the support panels and the second flexible strap extends over the two base ends and is attached to the support panels. In another embodiment, a single flexible strap is configured around the support and base end of a single support panel and has two extended ends that are attached to a support panel or to each other and to the support panel. In an exemplary embodiment, the extended ends are detachably attachable to the second support panel. The two flexible straps may be coupled together over a portion of the extended strap length between the two support panels to form a coupled strap portion. The two strap portions may be coupled together through any suitable means, including being adhered, stitched together, and the like. The coupled strap portion may comprise a detachable attachment, such as a hook and loop fastener or snaps, for example. In yet another embodiment, a sleeve is configured to extend around the support extended strap portion and the base extended strap portion, to couple these two strap portions together. A sleeve may be attached, detachably attached or free to slide along the extended length of the two strap portions between the two support panels.

In an exemplary embodiment, a support panel may be expandable in the width dimension, whereby two or more support panel sections can be folded open or otherwise arranged and coupled together to form a single support panel. In an exemplary embodiment, two support panel sections are coupled together by a hinge that enables the two sections to fold open to provide a wider support width. Two support panel sections may be coupled together by any suitable means, including a hinge, or strips of coupling material attached to both support sections, a binding, corrugation, hook-and-loop fasteners and the like.

In an exemplary embodiment, an elbow rest comprises a seat strap that extends from the base end of a support panel. A seat strap is configured to extend under a person's bottom and/or legs to provide a retaining force on the seat strap and secure the base end of the support panel from moving.

The summary of the invention is provided as a general introduction to some of the embodiments of the invention, and is not intended to be limiting. Additional example embodiments including variations and alternative configurations of the invention are provided herein.

BRIEF DESCRIPTION OF THE DRAWINGS

The accompanying drawings are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
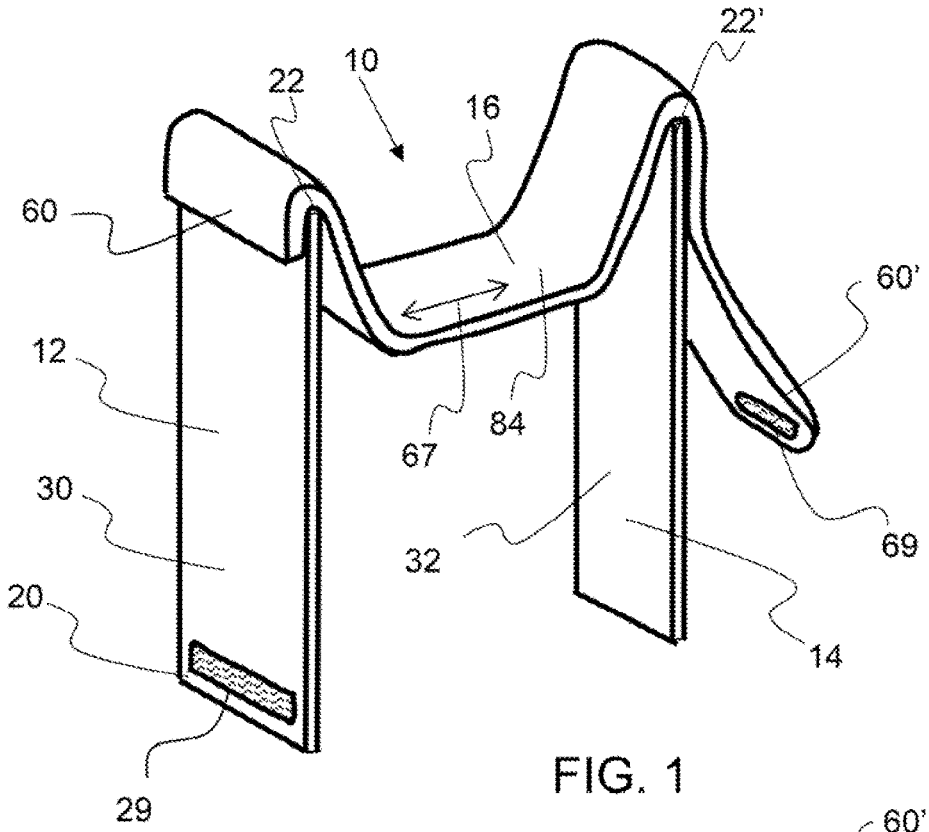

FIG. 1 shows an isometric view of an exemplary elbow rest comprising a first support panel, a second support panel and a flexible strap extending therebetween.

Figure 2:
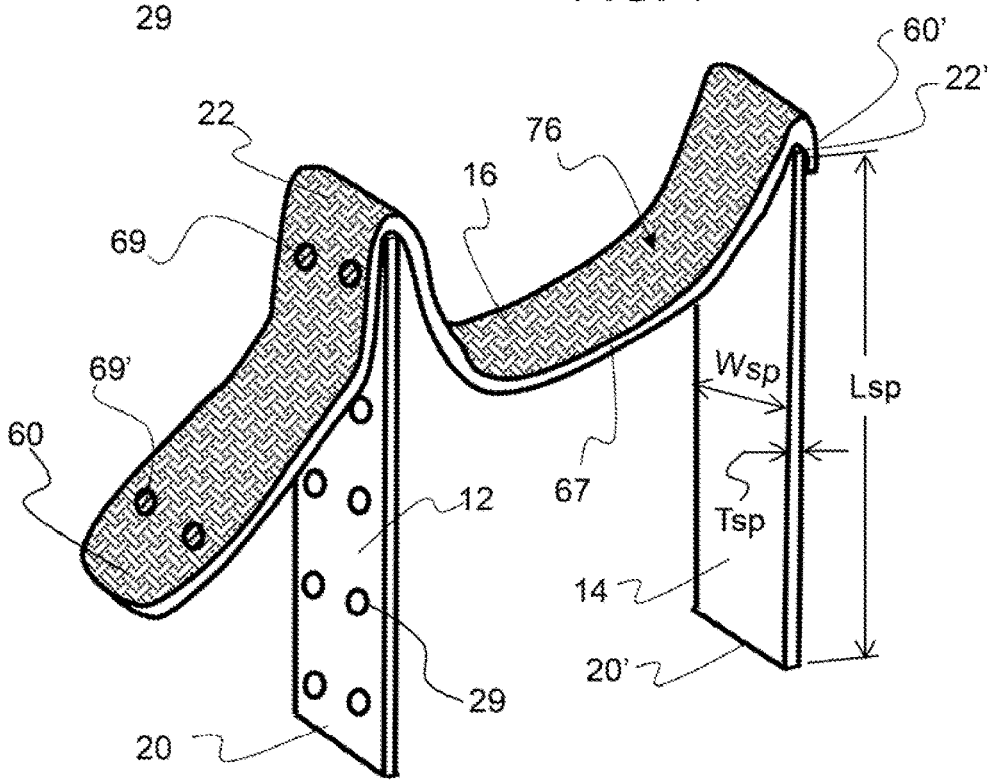

FIG. 2 shows an isometric view of an exemplary elbow rest comprising a first support panel, a second support panel and a flexible strap extending therebetween.

Figure 3:
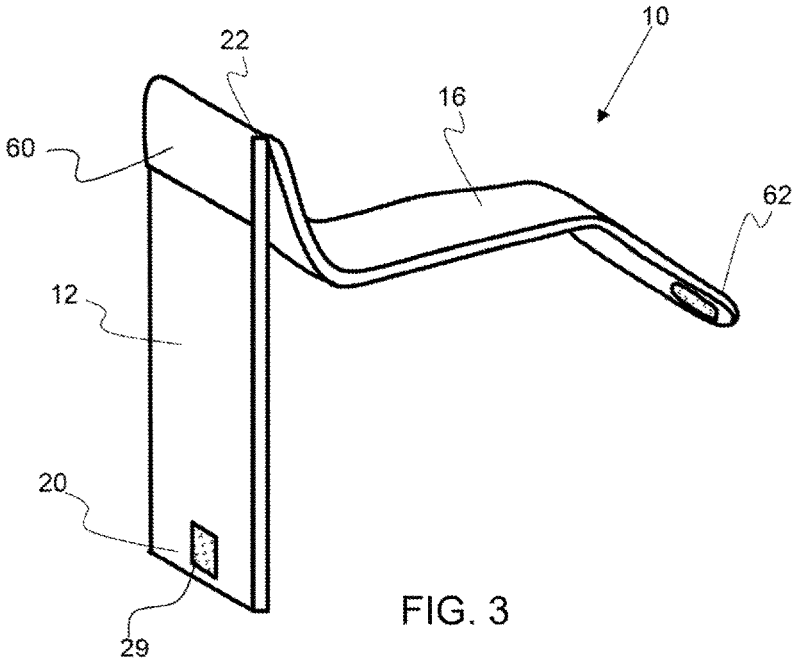

FIG. 3 shows an isometric view of an exemplary elbow rest comprising a first support panel and a flexible strap attached thereto.

Figure 4:
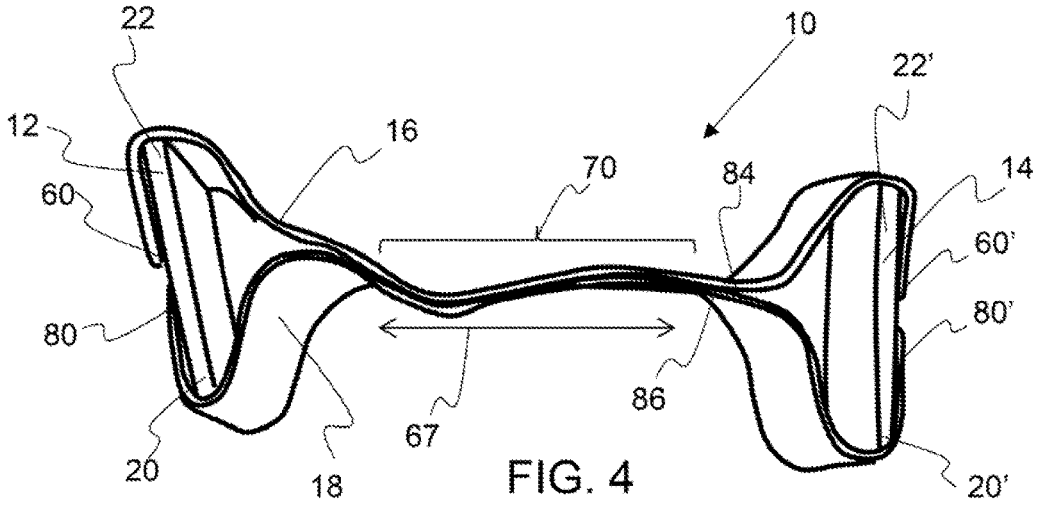

FIG. 4 shows an isometric view of an exemplary elbow rest comprising a first support panel, a second support panel, a first flexible strap and a second flexible strap extending therebetween.

Figure 5:
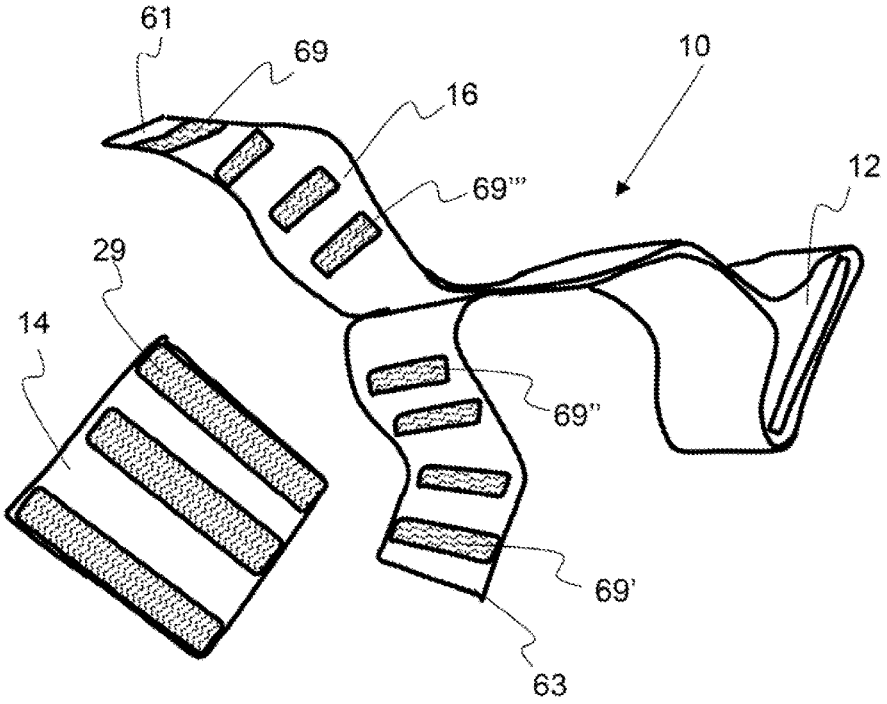

FIG. 5 shows an isometric view of an exemplary elbow rest comprising a first support panel, a second support panel, a contiguous flexible strap configured around a first support panel and detached from the second support panel.

Figure 6:
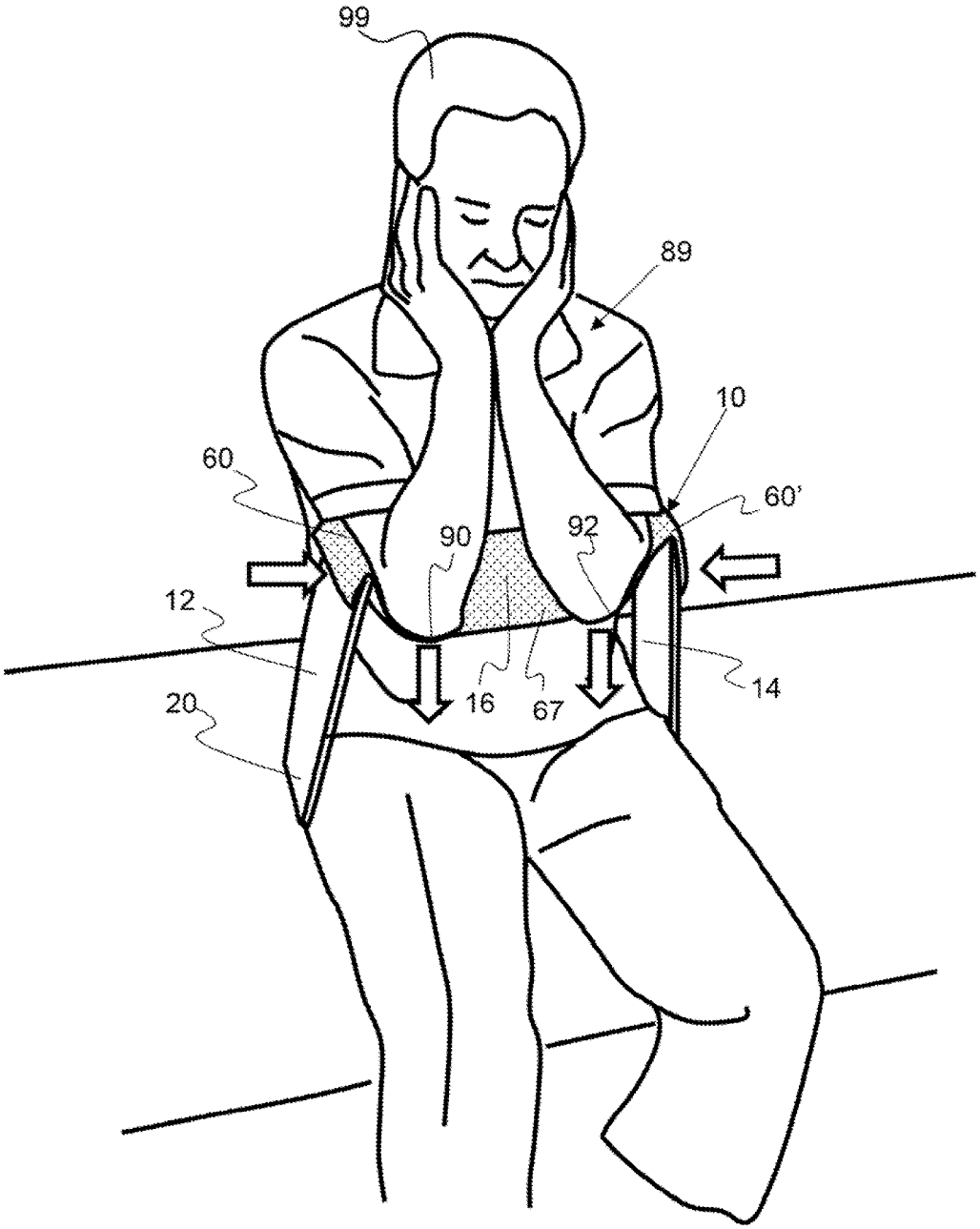

FIG. 6 shows an isometric view of a person resting their elbows on an exemplary elbow rest comprising a first support panel, a second support panel and a flexible strap extending therebetween.

Figure 7:
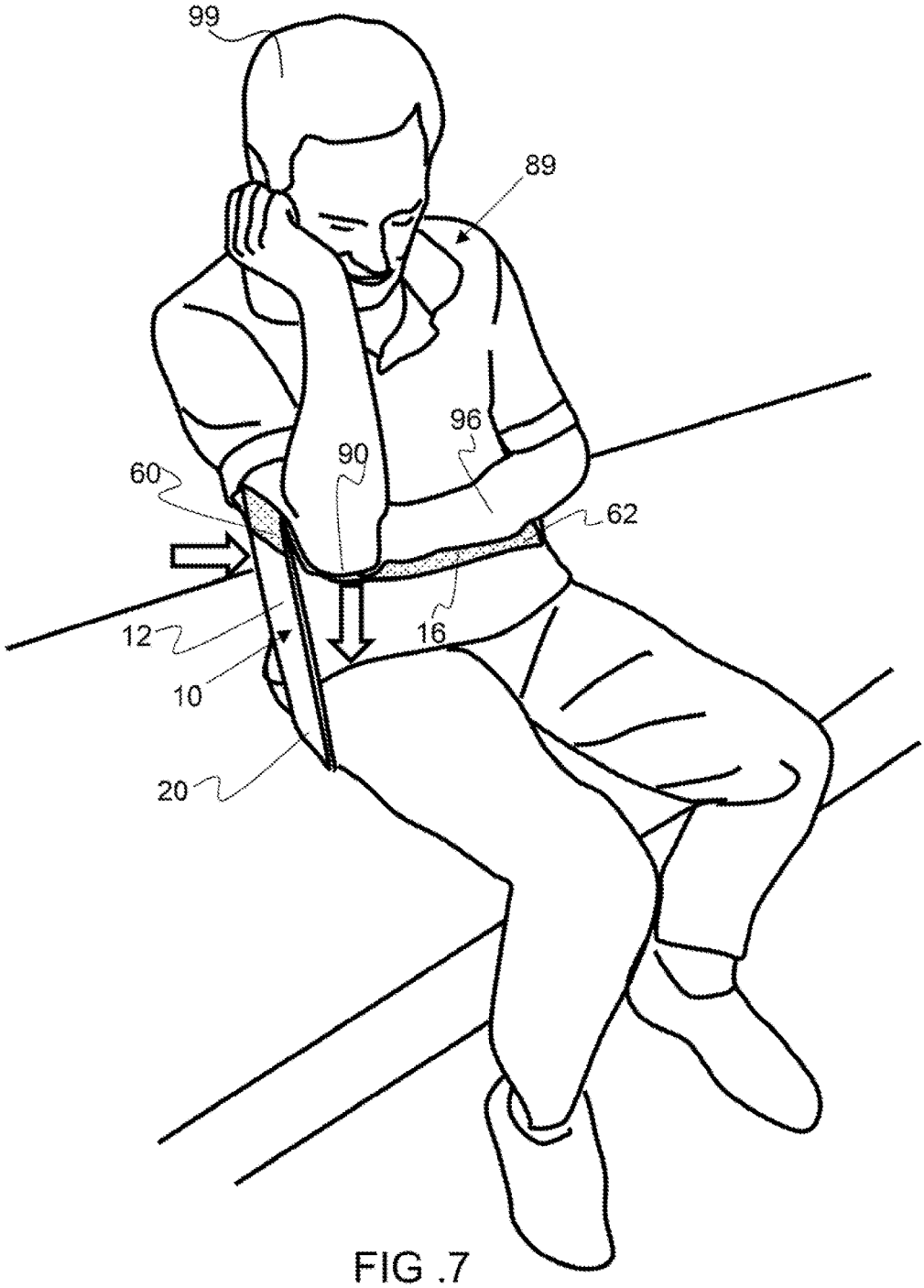

FIG. 7 shows an isometric view of a person resting a single elbow on an exemplary elbow rest comprising a first support panel and a flexible strap extending around a portion of the person's thorax or upper abdomen.

Figure 8:
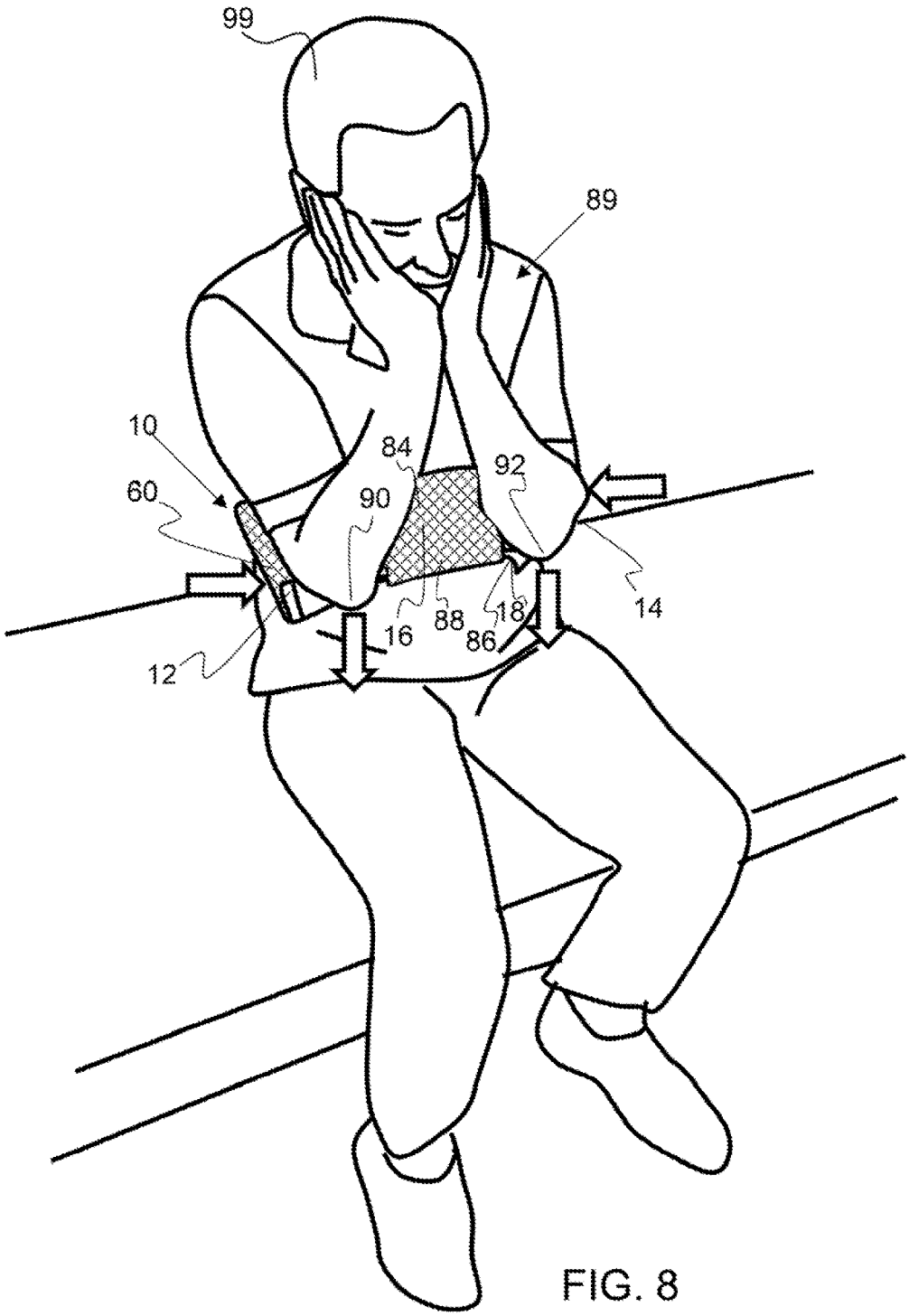

FIG. 8 shows an isometric view of a person resting their elbows on an exemplary elbow rest comprising a first support panel, a second support panel, a flexible strap extending therebetween to form a support extended strap portion, and a base extended strap portion.

Figure 9:
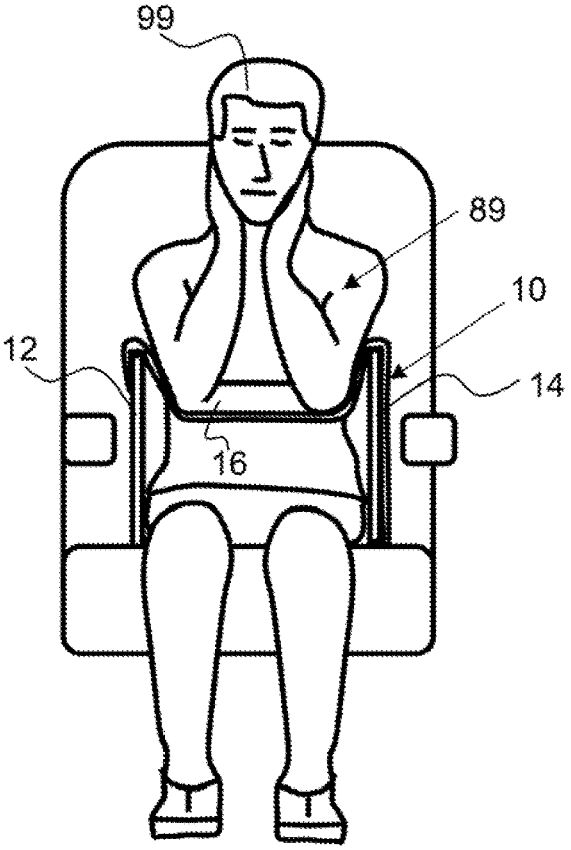

FIG. 9 shows a front view of a person resting their elbows on an exemplary elbow rest comprising a first support panel, a second support panel and a flexible strap extending therebetween.

Figure 10:
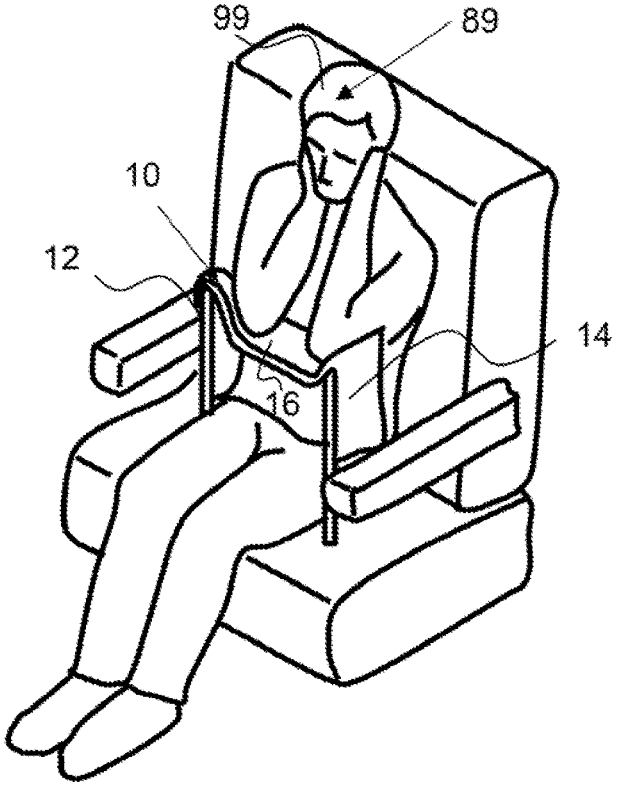

FIG. 10 shows an isometric view of a person resting their elbows on an exemplary elbow rest comprising a first support panel, a second support panel and a flexible strap extending therebetween.

Figure 11:
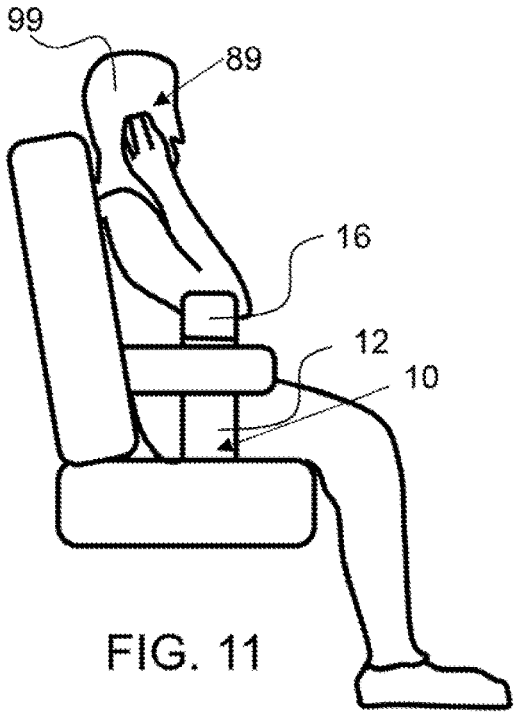

FIG. 11 shows a side view of a person resting an elbow on an exemplary elbow rest comprising a first support panel, a second support panel and a flexible strap extending therebetween.

Figure 12:
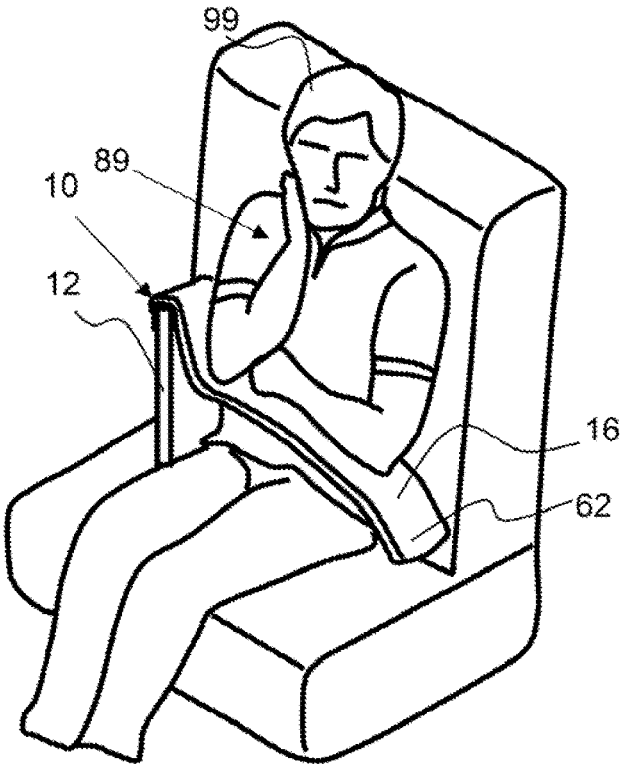

FIG. 12 shows an isometric view of a person resting their elbow on an exemplary elbow rest comprising a first support panel and a flexible strap extending over the person's thorax.

Figure 13:
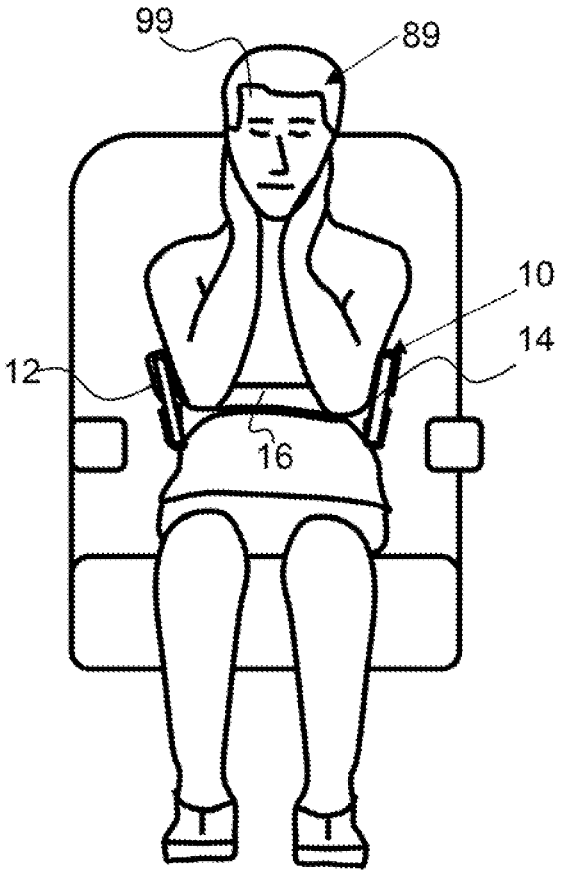

FIG. 13 shows a front view of a person resting their elbows on an exemplary elbow rest comprising a first support panel, a second support panel, a flexible strap extending therebetween to form a support extended strap portion, and a base extended strap portion.

Figure 14:
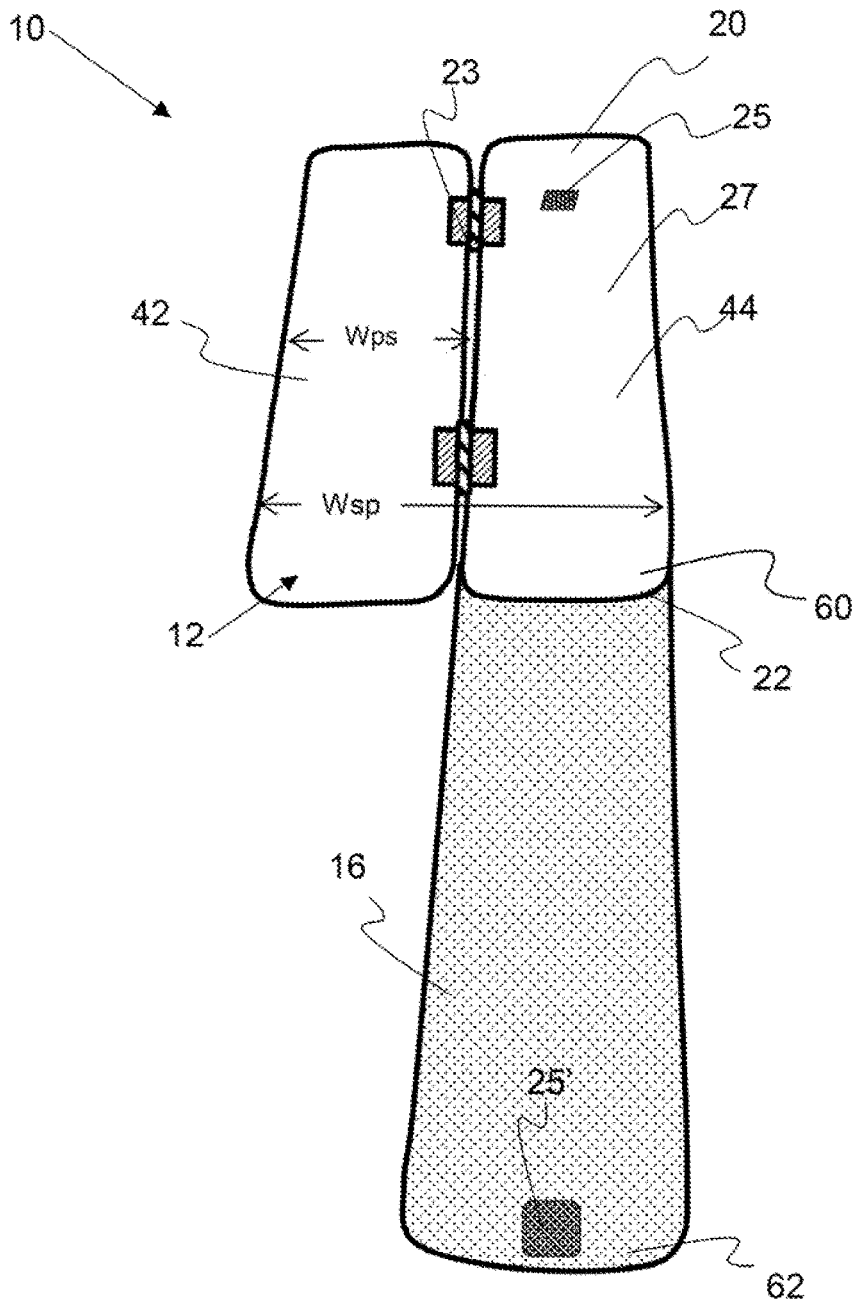

FIG. 14 shows top perspective view of an exemplary elbow rest comprising a folding support panel having a flexible strap extending therefrom.

Figure 15:
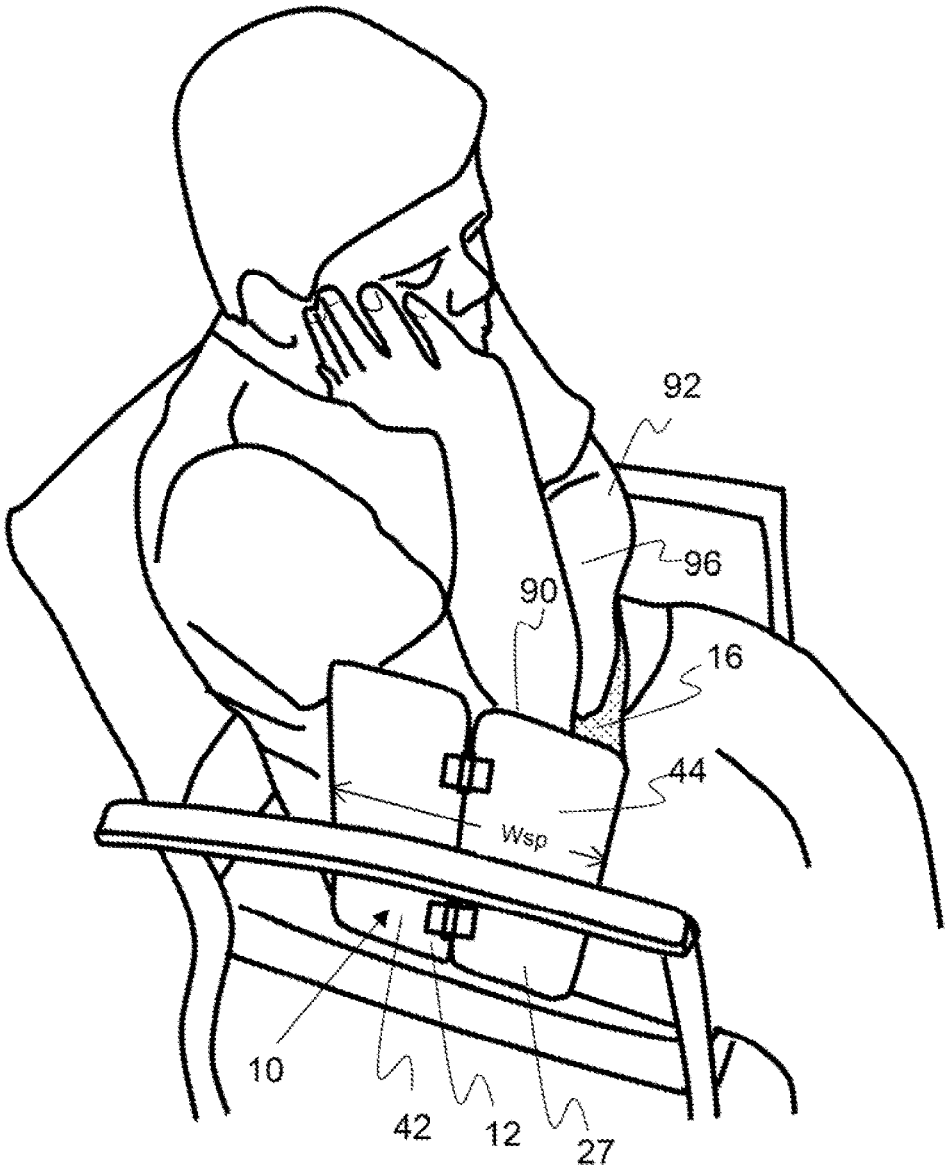

FIG. 15 shows a side perspective view of a person sitting in a chair with the exemplary elbow rest shown in FIG. 14 in an unfolded configuration and leaning against the arm of the chair.

Figure 16:
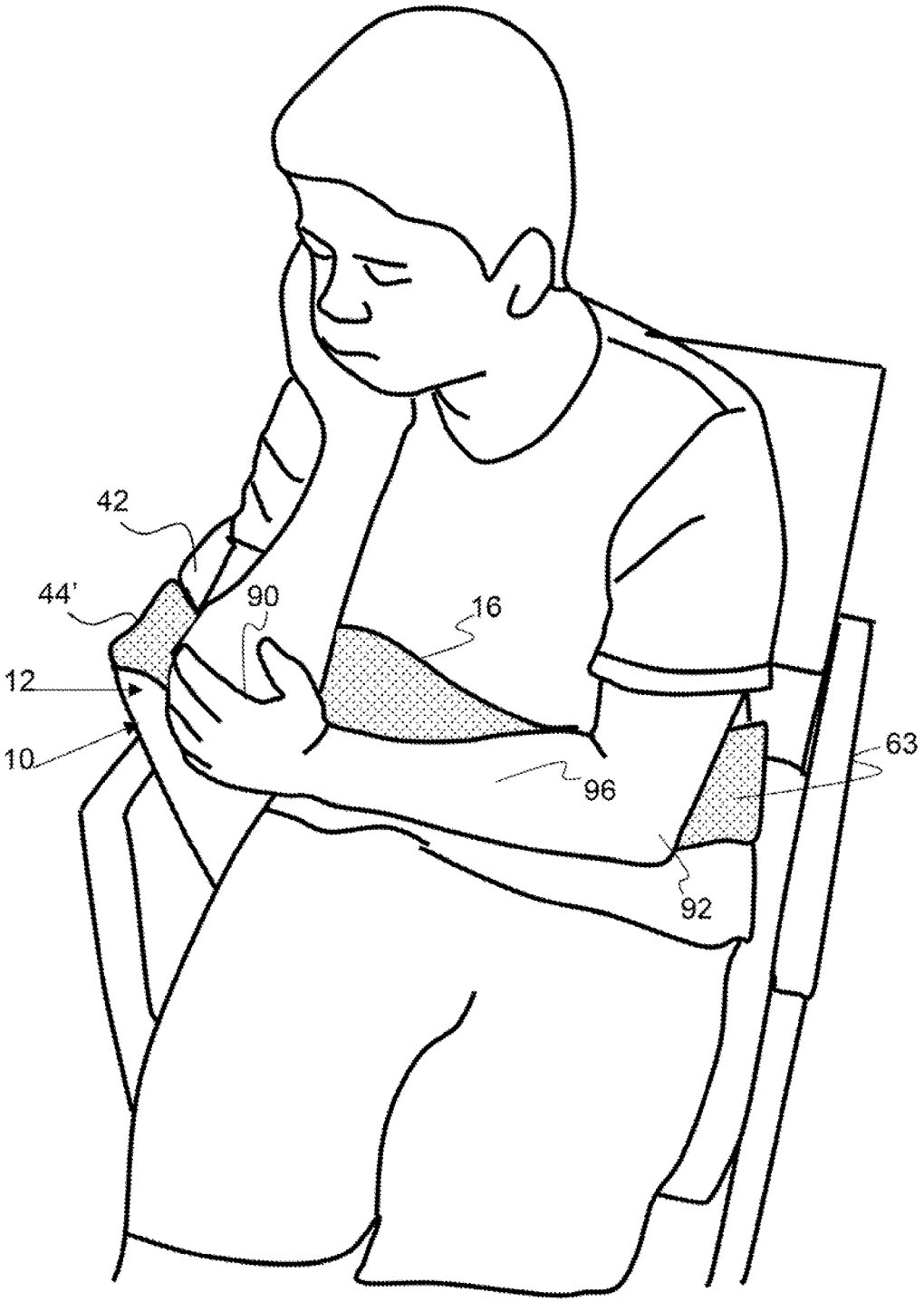

FIG. 16 shows a front perspective view of a person sitting in a chair with the exemplary elbow rest shown in FIG. 14 in an unfolded configuration and leaning against the arm of the chair.

Figure 17:
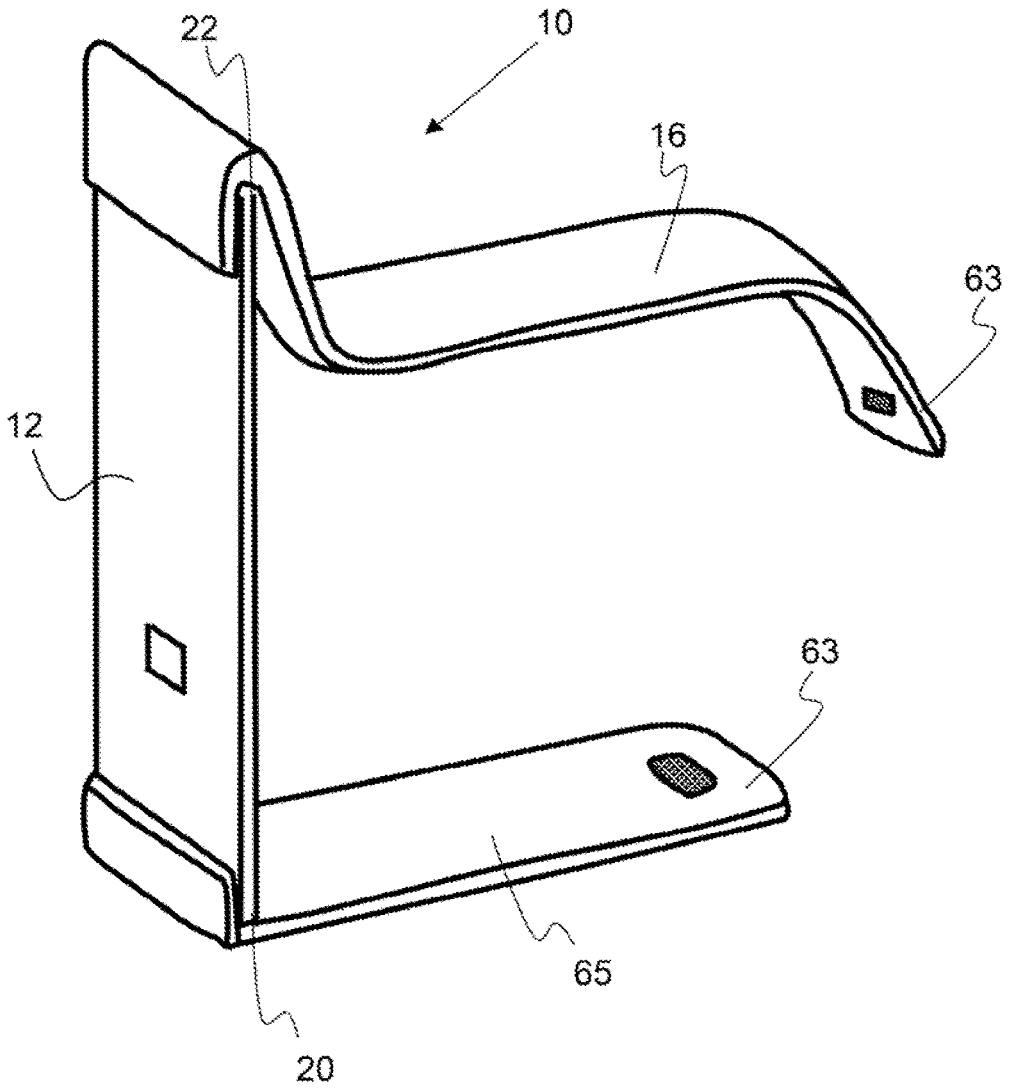

FIG. 17 shows a perspective view of an exemplary elbow rest having a single support panel with a flexible strap extending from the support end and a seat strap extending from the base end of the support panel.

Figure 18:
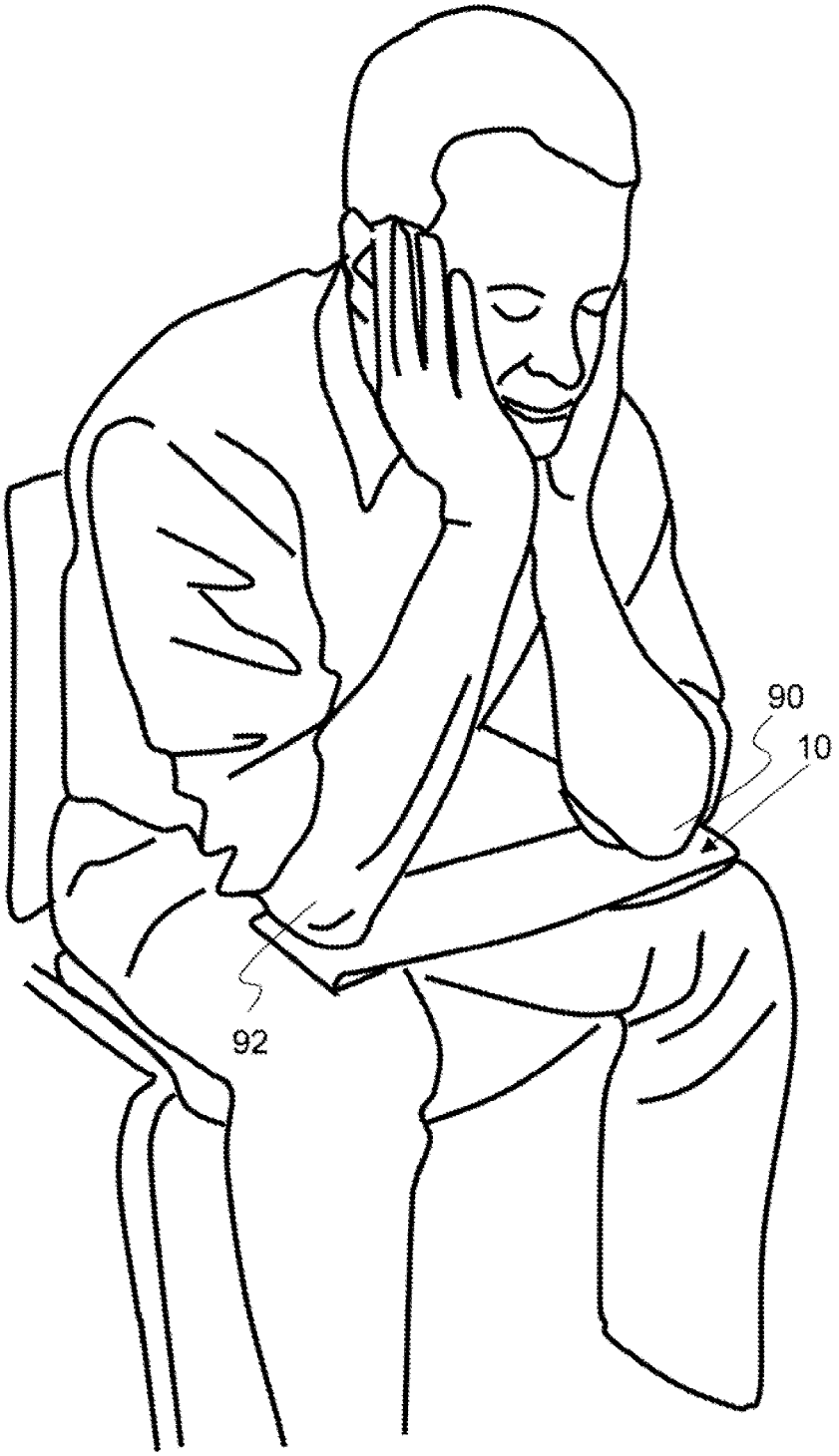

FIG. 18 shows a perspective view of a person resting their elbows on an exemplary elbow rest that is extending across their knees.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

As shown in FIG. 1 an exemplary elbow rest 10 comprises a first support panel 12, a second support panel 14 and a flexible strap 16 extending therebetween. The support panels have a base end 20 and a support end 22. The base end is configured to be placed on a support surface. The flexible strap extends over the support end and is attached to the outside surface 30 of the support panels. The flexible strap may also be attached to the inside surface 32 of the support panels. A panel attachment feature 29, a hook portion of a hook and loop fastener as shown, is configured on the outside surface of the support panels to detachably attach the flexible strap. The flexible strap 16 has a strap attachment feature 69, such as the loop portion of a hook and loop fastener. The support extended strap portion 84 of the strap 16 extends from the first support end 22 of the first support panel to the second support end 22' of the second support panel. An extended strap length is the length of the strap between the two support ends of the support panels. The first attached end 60 of the flexible strap is attached to the first support panel 12 near the top of the support panel and the second attached end 60' is shown being detached from the second support panel 14.

As shown in FIG. 2, an exemplary elbow rest comprises a first support panel 12, a second support panel 14 and a flexible strap 16 extending therebetween. The flexible strap has a non-slip surface 76 on the top surface. It is to be understood that the non-slip surface may also be configured on the bottom surface of a flexible strap to more retain the in a position about a person's thorax. In addition, panel attachment features 29, a plurality of snaps as shown, are configured on the support panel 12 for attaching the flexible strap 16 to the support panel. The flexible strap is configured with strap attachment features 69, the other portion of the snap, for attachment to the support panel. Panel attachment features. There are two snaps configured across the width of the flexible strap in two different locations along the length of the flexible strap. There are a number of snap-in features located along the length of the support panel to enable the flexible strap to be attached in different locations to change the length of the flexible strap between the two support panels. This configuration of the elbow rest 10 enables a user to place the first support panel 12 on one side and the second support panel 14 on a second, and opposing side, with the flexible strap 16 extending across the persons thorax area, or across their abdomen, as generally shown in FIG. 6. A user 89 can then rest their right elbow 90 on the flexible strap 16 proximal to the first support panel 12 and their left elbow 92 on the flexible strap proximal to the second support panel 14, as shown in FIG. 6. The user can then support their head 99 with their hands. Their elbows are held in a secure position on the straps and cannot slip outward as they are retained by the support panels.

As shown in FIG. 2, the support panel has a length Lsp from the base end to the support end, or bottom to top, a width Wsp and a thickness Tsp. The length of a support panel, Lsp, may be any suitable length including, but not limited to, about 5 inches or more, about 8 inches or more, about 10 inches or more, about 15 inches or more about 20 inches or more and any range between and including the length values provided. The width of a support panel, Wsp, may be any suitable width including, but not limited to, no more than about 2 inches, no more than about 4 inches, no more than about 6 inches, no more than about 8 inches or no more than about 10 inches and any range between and including the width values provided. The thickness of a support panel, Tsp, may be any suitable thickness including, but not limited to, no more than about 2 inches, no more than about 1 inch, no more than about 0.5 inch or no more than about 0.25 inch and any range between and including the width values provided.

As shown in FIG. 3, an exemplary elbow rest 10 comprises a first support panel 12 and a flexible strap 16 attached thereto. The flexible strap has an attached end 60 attached to the first support panel and an extended end 62. In this configuration, the first support panel can be placed along the side of a seated user and the extended end can be draped around the thorax of the user, secured with their far arm from the support panel. The elbow of the arm proximal to the support panel can be rested on the flexible strap proximal to the support panel, as generally shown in FIG. 7.

As shown in FIG. 4, an exemplary elbow rest 10 comprises a first support panel 12, a second support panel 14, a support extended strap portion 84 and a base extended strap portion 86. The support extended strap portion 84 extends from the support ends 22, 22' of the first and second support panels and the base extended strap portion 86 extends from the base ends 20, 20' of the first and second support panels. As shown in FIG. 4, two separate flexible straps are configured between the support panels. The first flexible strap 16 extends over the two support ends 22,22' and is attached to the support panels and the second flexible strap 18 extends over the two base ends 20, 20' and is attached to the support panels. The first flexible strap 16 has attached ends 60, 60' and the second flexible strap 18 has attached ends 80, 80'. The two flexible straps 16, 18 are coupled together over a portion of the extended strap length 67 to form a coupled strap portion 70.

As shown in FIG. 5, an exemplary elbow rest 10 comprises first support panel 12, a second support panel 14, and a contiguous flexible strap 16 configured around the first support panel 12 and detached from the second support panel 14. The second support panel 14 is detached from the flexible strap 16. Panel attachment features, such a hook portion of a hook and loop fastener, are configured for attachment to the loop portion of a hook and loop fastener 69 on the flexible strap on both the first end 61 and second end 63. As shown in FIG. 5, a flexible strap may be configured with a plurality of strap attachment features 69 configured along the length of the flexible strap to enable a person to adjust the width or distance between support panels. This allows a single elbow rest to be used by a wide range of users, from large adults to small children. A person may choose to attach strap attachment features 69" and 69''' to the support panel 14 to reduce the distance between the support panels 14 and 12.

As shown in FIG. 6, a seated user 89 is resting their elbows 90, 92 on an exemplary elbow rest 10 comprising a first support panel 12, a second support panel 14 and a flexible strap 16 extending therebetween. The base ends 20 of the support panels are configured along opposing sides of the user 89 with the support panels extending vertically up from the base end. The user's elbows are retained by the elbow rest 10, with their first elbow, or right elbow 90 retained on the flexible strap proximal to the first support panel and their second, or left 92 retained on the flexible strap proximal to the second support panel. The force of the person's elbows down on the flexible strap, as indicated by the bold downward arrows, pulls on the flexible strap to cause the support ends 60, 60' of the support panels to be forced inward, thereby retaining the elbows. This unique configuration positively secures the user's elbows in a retained position, whereby they can support their head 99 with their hands.

As shown in FIG. 7 a seated user 89 is resting their right elbow 90 on an exemplary elbow rest 10 comprising a first support panel 12, a second support panel 14 and a flexible strap 16. The base end 20 of the support panel is configured along the right side of the user 89 with the support panel extending vertically up from the base end. The user's elbow is retained by the elbow rest 10 with their first elbow, or right elbow 90, retained on the flexible strap proximal to the first support panel and the their far arm 96 retained on the extended portion of the flexible strap that is configured across their thorax, or over the top of their abdomen. The free or extended end of the flexible strap is configured across the user's body and their far arm, far from the first support panel location, is resting on the flexible strap 16 and holding it in position. The force of the user's far arm on the flexible strap retains the flexible strap in position and keeps the support end 60 of the support panel in position. The downward force of the right elbow 90 also pulls the support panel in toward the user as indicated by the bold arrows.

As shown in FIG. 8, a user 89 is resting their elbows on an exemplary elbow rest 10 comprising a first support panel 12, a second support panel 14 and a flexible strap 16 extending therebetween to form a support extended strap portion 84 and a base extended strap portion 86. Again, the downward force of the user's elbows 90, 92, pull in on the support panels 12, 14 to retain their elbows in position. A sleeve 88 is configured around the support extended strap portion 84 and the base extended strap portion 86 to couple said portions together between the two support panels.

As shown in FIG. 9 through FIG. 11, a person is resting their elbows on an exemplary elbow rest 10 comprising a first support panel 12, a second support panel 14 and a flexible strap extending therebetween 16. The person's head 99 is being supported by their hands.

As shown in FIG. 12, a person is resting their elbow on an exemplary elbow rest comprising a first support panel 12 and a flexible strap 16 extending over the person's thorax.

As shown in FIG. 13, a person is resting their elbows on an exemplary elbow rest comprising a first support panel 12, a second support panel 14 and a flexible strap extending therebetween to form a support extended strap portion and a base extended strap portion.

As shown in FIG. 14 an exemplary elbow rest 10 comprises a folding support panel 27 having two support panel sections 42, 44. A flexible strap 16 is coupled with and is extending from the support end of the second support panel section 44. The flexible strap 16 is configured to be folded between the two support panel sections and retained therein when the support panel is closed or folded together. A hook portion 25' of a hook-and-loop fastener is configured proximal to the extended end of the flexible strap such that it will couple with the loop portion 25 of a hook-and-loop fastener configured on the second support panel 44. A pair of hinges are configured between the two support panel sections and are configured to allow the two panel sections to pivot open to provide a wider support panel width Wsp.

With reference now to FIGS. 15 and 16, a person is sitting in a chair with the exemplary elbow rest 10 shown in FIG. 14 in an unfolded configuration and leaning against the arm of the chair. The flexible strap 16 is extending from the support end of the second support panel section 44 and the person's first elbow 90 is resting on the flexible strap proximal to the support panel 12. The flexible strap is extending across the person waist, thorax, or more specifically their abdomen, and their far elbow 92 and far arm 96 are resting on the flexible strap. The weight of the person's far arm and elbow retain the flexible strap in a secure position.

As shown in FIG. 17, an exemplary elbow rest 10 has a single support panel 12 with a flexible strap 16 extending from the support end 22 and a seat strap 65 extending from the base end 20 of the support panel. The seat strap may be configured under a person's bottom or under their thigh to retain and secure the support panel in a fixed position. The wait of a person sitting on the seat strap will effectively prevent the base end 20 of the support panel from slipping as they rest with their elbow on the flexible strap.

As shown in FIG. 18, a person is resting their elbows on an exemplary elbow rest that is extending across their knees. The flexible strap may comprise a slip resistant surface that may aid in securing on or both elbows of a person in a fixed position.

The present invention provides an elbow rest and a method to support a user's head utilizing the elbow rest. In an exemplary embodiment, a user may position a first support panel along their side with the first base end secured on support structure, such as a chair, bench or ground with the base end proximal to the side of their hip or seat and the support end extended up along their side. The user may then extend the flexible strap across their thorax or waist as generally shown in FIGS. 7, 11, 12, and 16. A user may then rest their first elbow of a first arm on the flexible strap proximal to the support end and their second arm on the strap. The second elbow of the user's second arm may be placed on the flexible strap proximal to the extended end and the forearm may rest along a portion of the length of the flexible strap to secure it in position.

In another exemplary method, an elbow rest comprises a first and a second support panel and flexible strap extending between the support ends of the first and second support panels. A user may place the first and second support panels along their sides with the base ends secured on a support surface and proximal to their hips, top of their legs, and seat, as generally shown in FIGS. 6, 9 and 10. A user may then rest their first elbow and second elbow on the flexible strap proximal to the first support end and second support end of the first and second support panels, respectively. A user may then support their head on their hands as shown in FIG. 6.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A method of using an elbow rest to support a user's head comprising the steps of:

a) providing an elbow, rest comprising:
  a first support panel comprising:
    i. a first base end;
    ii. a first support end;
    iii. a flexible strap having an attached end attached to said first support panel and extending from said first support end to an extended end; a seat strap that is attached to the first support panel and extends from the first base end;

wherein the elbow rest is configured for a user to secure said first support panel along a side of said user and rest an elbow on said flexible strap proximate to said first support end b) securing the first support panel along a first side of said user with the first support end extending up from the first base end;

c) placing the flexible strap across a thorax of said user, position the seat strap under said user's buttocks or thighs, and resting first elbow on the flexible strap proximal to the first support end; and d) resting said users head on a first hand extending from the first elbow to support said users head.

2. The method of supporting a users head of claim 1, wherein the elbow rest further comprises:

a) a second support panel comprising:
  a second base end;
  a second support end; and
  wherein flexible support strap extends from the first support end of the first support panel to the second support end of the second support panel; and the method further comprises the steps of:

b) securing the second panel along a second and opposing side of said user with the second support end extending up from the second base end;

c) resting a second elbow on the flexible strap proximal to the second support end; and d) resting said user's head on both the first hand extending from the first elbow and a second hand extending from the second elbow to support said user's head.

3. The method of supporting a user's head of claim 2, wherein the flexible strap is detachably attachable to at least one of the first or second support panels.

4. The method of supporting a user's head of claim 2, wherein the elbow rest further comprises a base extended strap portion that extends from the first base end to the second base end.

5. The method of supporting a user's head of claim 4, wherein the flexible strap and the base extended strap portion are attached to each other to form a coupled strap portion between the first and second support panels.

6. The method of supporting a user's head of claim 1, wherein the first support panel is an elongated support panel having a length that is at least double a width.

7. The method of supporting a user's head of claim 6, wherein the length is at least 10 inches.

8. The method of supporting a user's head of claim 1, wherein the flexible strap as a length that is at least as long as a length of the first support panel.

9. The method of supporting a user's head of claim 1, wherein the first support panel has a thickness of no more than about 0.25 inch.

10. The method of supporting a user's head of claim 1, wherein the elbow rest further comprises:

a first support panel section; and
a second support panel section;
a hinge coupling the first and second support panel sections;
wherein the first and second support panel sections are configured to unfold to provide a support panel width that is greater than a first or second support panel section width.

11. A method of supporting a user's head comprising the steps of:

a) providing an elbow rest comprising:
  a first support panel comprising:
    i. a first base end;
    ii. a first support end;
    iii. a flexible strap having an attached end attached to said first support panel and extending from said first support end to an extended end;

wherein the elbow rest is configured for a user to secure said first support panel along a side of said user and rest an elbow on said flexible strap proximate to said support end b) securing the first panel along a first side of said user with the first support end extending up from the first base end;

c) placing the flexible strap across a thorax of said user and resting a first elbow on the flexible strap proximal to the first support end; and resting said user's head on a first hand extending from the first elbow to support said user's head;
  wherein the flexible strap extends around an outside surface of the first support panel and extends from the first support end and the first base end and has two extended ends that are detachably attachable to a second support panel.

* * * * *